US010144026B2

(12) United States Patent
Mizushima et al.

(10) Patent No.: US 10,144,026 B2
(45) Date of Patent: Dec. 4, 2018

(54) FOAMER DISPENSER, AND CONTAINER WITH FOAMER DISPENSER

(71) Applicants: Hiroshi Mizushima, Tokyo (JP); Tsuyoshi Sasaki, Tokyo (JP)

(72) Inventors: Hiroshi Mizushima, Tokyo (JP); Tsuyoshi Sasaki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/904,798

(22) PCT Filed: Jul. 17, 2014

(86) PCT No.: PCT/JP2014/003814

§ 371 (c)(1),
(2) Date: Jan. 13, 2016

(87) PCT Pub. No.: WO2015/008494

PCT Pub. Date: Jan. 22, 2015

(65) Prior Publication Data

US 2016/0167075 A1 Jun. 16, 2016

(30) Foreign Application Priority Data

Jul. 17, 2013 (JP) ..... 2013-148954
Jul. 17, 2013 (JP) ..... 2013-148956

(51) Int. Cl.
*B05B 11/00* (2006.01)
*B05B 7/00* (2006.01)

(52) U.S. Cl.
CPC ..... *B05B 11/3087* (2013.01); *B05B 7/0037* (2013.01); *B05B 11/0016* (2013.01);
(Continued)

(58) Field of Classification Search
CPC ..... B05B 11/0016; B05B 11/3001; B05B 11/3022; B05B 11/3047; B05B 11/3059;
(Continued)

(56) References Cited

U.S. PATENT DOCUMENTS

2002/0000452 A1* 1/2002 Iizuka ..... B05B 7/0037 222/190
2006/0219738 A1* 10/2006 Iizuka ..... A45D 34/04 222/190

(Continued)

FOREIGN PATENT DOCUMENTS

CN 1819876 A 8/2006
CN 101232949 A 7/2008

(Continued)

OTHER PUBLICATIONS

Dec. 9, 2016 Office Action issued in Korean Patent Application No. 10-2016-7000937.

(Continued)

*Primary Examiner* — Frederick C Nicolas
*Assistant Examiner* — Bob Zadeh
(74) *Attorney, Agent, or Firm* — Oliff PLC

(57) ABSTRACT

A foamer dispenser including a mesh filter that is disposed in a mixture flow path of a jet ring to allow a mixture to pass is provided. A connecting flow path area between a liquid flow path and the mixture flow path and a connecting flow path area between an ambient air flow path and the mixture flow path have the relation $2.8 \leq S_1/S_2 \leq 3.8$, and/or, a smallest flow path area of the mixture flow path is located on an immediately upstream side of the mesh filter, and the smallest flow path area and a flow path area of the mesh filter have the relation $4 \leq S_4/S_3 \leq 10.3$.

10 Claims, 5 Drawing Sheets

(52) U.S. Cl.
CPC ..... *B05B 11/0064* (2013.01); *B05B 11/0075* (2013.01); *B05B 11/3001* (2013.01); *B05B 11/3059* (2013.01); *B05B 11/3097* (2013.01); *B05B 11/3047* (2013.01)

(58) Field of Classification Search
CPC ..... B05B 11/3087; B05B 7/0062; B05B 11/0064; B05B 7/0037; B05B 11/3097; B05B 11/0075
See application file for complete search history.

(56) References Cited

U.S. PATENT DOCUMENTS

| | | | | |
|---|---|---|---|---|
| 2006/0283887 | A1* | 12/2006 | Jahan | B05B 7/0037 222/190 |
| 2008/0093386 | A1* | 4/2008 | Arminak | B05B 11/3047 222/190 |
| 2009/0255957 | A1 | 10/2009 | Mizushima et al. | |
| 2009/0266846 | A1* | 10/2009 | Iizuka | B05B 11/3087 222/190 |
| 2011/0031276 | A1 | 2/2011 | Mizushima et al. | |
| 2011/0272488 | A1* | 11/2011 | Baughman | B05B 7/0037 239/311 |
| 2013/0068794 | A1 | 3/2013 | Kodama et al. | |
| 2016/0167075 | A1* | 6/2016 | Mizushima | B05B 11/0016 222/189.11 |

FOREIGN PATENT DOCUMENTS

| | | | | | |
|---|---|---|---|---|---|
| JP | H08-230961 | A | | 9/1996 | |
| JP | H10-397 | A | | 1/1998 | |
| JP | 2005-262202 | A | | 9/2005 | |
| JP | 2012-110799 | A | | 6/2012 | |
| JP | 2012110799 | A | * | 6/2012 | B05B 7/0037 |
| KR | 20080056148 | A | | 6/2008 | |
| WO | 2005/080003 | A1 | | 9/2005 | |
| WO | 2007/013549 | A1 | | 2/2007 | |
| WO | 2011/152375 | A1 | | 12/2011 | |

OTHER PUBLICATIONS

Sep. 29, 2016 Office Action issued in Chinese Patent Application No. 201480040151.8.
Oct. 4, 2016 Office Action issued in Japanese Patent Application No. 2013-148956.
Oct. 4, 2016 Office Action issued in Japanese Application No. 2013-148954.
Jun. 2, 2016 Office Action issued in Australian Patent Application No. 2014291498.
Oct. 28, 2014 International Search Report issued in International Patent Application No. PCT/JP2014/003814.
Feb. 20, 2017 Office Action issued in Canadian Patent Application No. 2918292.
Mar. 2, 2017 extended Search Report issued in European Patent Application No. 14826708.1.
Oct. 19, 2017 Office Action issued in Canadian Patent Application No. 2,918,292.
May 9, 2017 Office Action issued in Chinese Patent Application No. 201480040151.8.
Mar. 2, 2018 Office Action issued in Australian Patent Application No. 2017201931.

* cited by examiner

FOAMER DISPENSER, AND CONTAINER WITH FOAMER DISPENSER

TECHNICAL FIELD

The present disclosure relates to a foamer dispenser, and a container with the foamer dispenser.

BACKGROUND

Some known containers are equipped with a foamer dispenser that causes a liquid pumped out of a container body to be ejected in the form of foam through a foaming net (mesh filter) by repeated pushing and releasing of the head. (Refer to Patent Literature 1, for example.)

CITATION LIST

Patent Literature

PTL1: JPH08230961A

SUMMARY

Technical Problem

Even such a conventional foamer dispenser can suffer from variation in foam quality depending on ingredients or the like of the liquid to be foamed. For example, as illustrated in FIG. 5A, even in a single piece of foam F, a small air bubble $B_1$ and a large air bubble $B_2$ are sometimes present. For the foam with such a quality, there is room for improvement in terms of the appearance and texture.

The present disclosure is to provide a foamer dispenser and a container with the foamer dispenser both of which are capable of ejecting a content medium with a satisfactory foam quality.

Solution to Problem

One of aspects of the present disclosure resides in a foamer dispenser, including: a pump cover that is fitted to a container body; a pump cylinder that includes a large-diameter portion fixed to the pump cover and a small-diameter portion; a small-diameter piston that is received in the small-diameter portion of the pump cylinder and that is configured to suck and pump a liquid in the container body; a large-diameter piston that is received in the large-diameter portion of the pump cylinder and that is configured to suck and pump ambient air; a head that causes pumping movement of the small-diameter piston and the large-diameter piston and that ejects a mixture of the liquid and the ambient air by a user pushing and releasing the head repeatedly; a liquid flow path of the liquid pumped from the small-diameter piston; an ambient air flow path of the ambient air pumped from the large-diameter piston; a mixture flow path of the mixture of the liquid pumped from the liquid flow path and the ambient air pumped from the ambient air flow path; and a mesh filter that is disposed in the mixture flow path to allow the mixture to pass, wherein a connecting flow path area $S_1$ between the liquid flow path and the mixture flow path and a connecting flow path area $S_2$ between the ambient air flow path and the mixture flow path have the following relation:

$$2.8 \leq S_1/S_2 \leq 3.8$$

$$(S_1:S_2=(2.8 \text{ to } 3.8):1)$$

In a preferred embodiment, the connecting flow path area $S_1$ and the connecting flow path area $S_2$ have the following relation:

$$S_1/S_2=3.8$$

$$(S_1:S_2=3.8:1)$$

In another preferred embodiment, a smallest flow path area $S_3$ of the mixture flow path is located on an immediately upstream side of the mesh filter, and the smallest flow path area $S_3$ and a flow path area $S_4$ of the mesh filter have the following relation:

$$4 \leq S_4/S_3 \leq 10.3$$

$$(1:4 \leq S_3:S_4 \leq 1:10.3)$$

$$(S_3:S_4=1:(4 \text{ to } 10.3))$$

Another aspect of the present disclosure resides in a foamer dispenser, including: a pump cover that is fitted to a container body; a pump cylinder that includes a large-diameter portion fixed to the pump cover and a small-diameter portion; a small-diameter piston that is received in the small-diameter portion of the pump cylinder and that is configured to suck and pump a liquid in the container body; a large-diameter piston that is received in the large-diameter portion of the pump cylinder and that is configured to suck and pump ambient air; a head that causes pumping movement of the small-diameter piston and the large-diameter piston and that ejects a mixture of the liquid and the ambient air by a user pushing and releasing the head repeatedly; a liquid flow path of the liquid pumped from the small-diameter piston; an ambient air flow path of the ambient air pumped from the large-diameter piston; a mixture flow path of the mixture of the liquid pumped from the liquid flow path and the ambient air pumped from the ambient air flow path; and a mesh filter that is disposed in the mixture flow path to allow the mixture to pass, wherein a smallest flow path area $S_3$ of the mixture flow path is located on an immediately upstream side of the mesh filter, and the smallest flow path area $S_3$ and a flow path area $S_4$ of the mesh filter have the following relation:

$$4 \leq S_4/S_3 \leq 10.3$$

$$(1:4 \leq S_3:S_4 \leq 1:10.3)$$

$$(S_3:S_4=1:(4 \text{ to } 10.3))$$

In a preferred embodiment, the smallest flow path area $S_3$ and the flow path area $S_4$ of the mesh filter have the following relation:

$$4 \leq S_4/S_3 \leq 10.1$$

$$(1:4 \leq S_3:S_4 \leq 1:10.1)$$

$$(S_3:S_4=1:(4 \text{ to } 10.1))$$

In another preferred embodiment, the smallest flow path area $S_3$ and the flow path area $S_4$ of the mesh filter have the following relation:

$$4 \leq S_4/S_3 \leq 6.2$$

$$(1:4 \leq S_3:S_4 \leq 1:6.2)$$

$$(S_3:S_4=1:(4 \text{ to } 6.2))$$

In a more preferred embodiment, the smallest flow path area $S_3$ and the flow path area $S_4$ of the mesh filter have the following relation:

$S_4/S_3=4$ $(S_3:S_4=1:4)$

In yet another preferred embodiment, the mesh filter is arranged in 2 locations in the mixture flow path, and an interval $L_1$ between the smallest flow path area $S_3$ and the flow path area $S_4$ of the mesh filter and an interval $L_2$ between the mesh filters have the following relation:

$L_2/L_1=3.9$ $(L_1:L_2=1:3.9)$

In yet another preferred embodiment, the foamer dispenser further includes: a piston guide, inside of which the liquid flow path of the liquid pumped from the small-diameter piston is formed, and which extends throughout the large-diameter piston in a manner such that relative movement is permitted; and a jet ring, which includes a lower-end side concave portion in which an upper end side of the piston guide is received, an upper-end side concave portion in which the mesh filter is received, and a through path provided in a separation wall separating the lower-end side concave portion from the upper-end side concave portion, wherein an upper end side of the jet ring is connected to the head.

Yet another aspect of the present disclosure resides in a container with a foamer dispenser, including: the foamer dispenser according to any one of the above embodiments; and a container body to which the foamer dispenser is fitted.

Advantageous Effect

The present disclosure makes the foam quality of the ejected foam fine and uniform, thereby improving the appearance and texture when a user places the foam on the hand.

DETAILED DESCRIPTION

The following describes a container with a foamer dispenser according to the present disclosure in detail with reference to the drawings.

Figure 1:
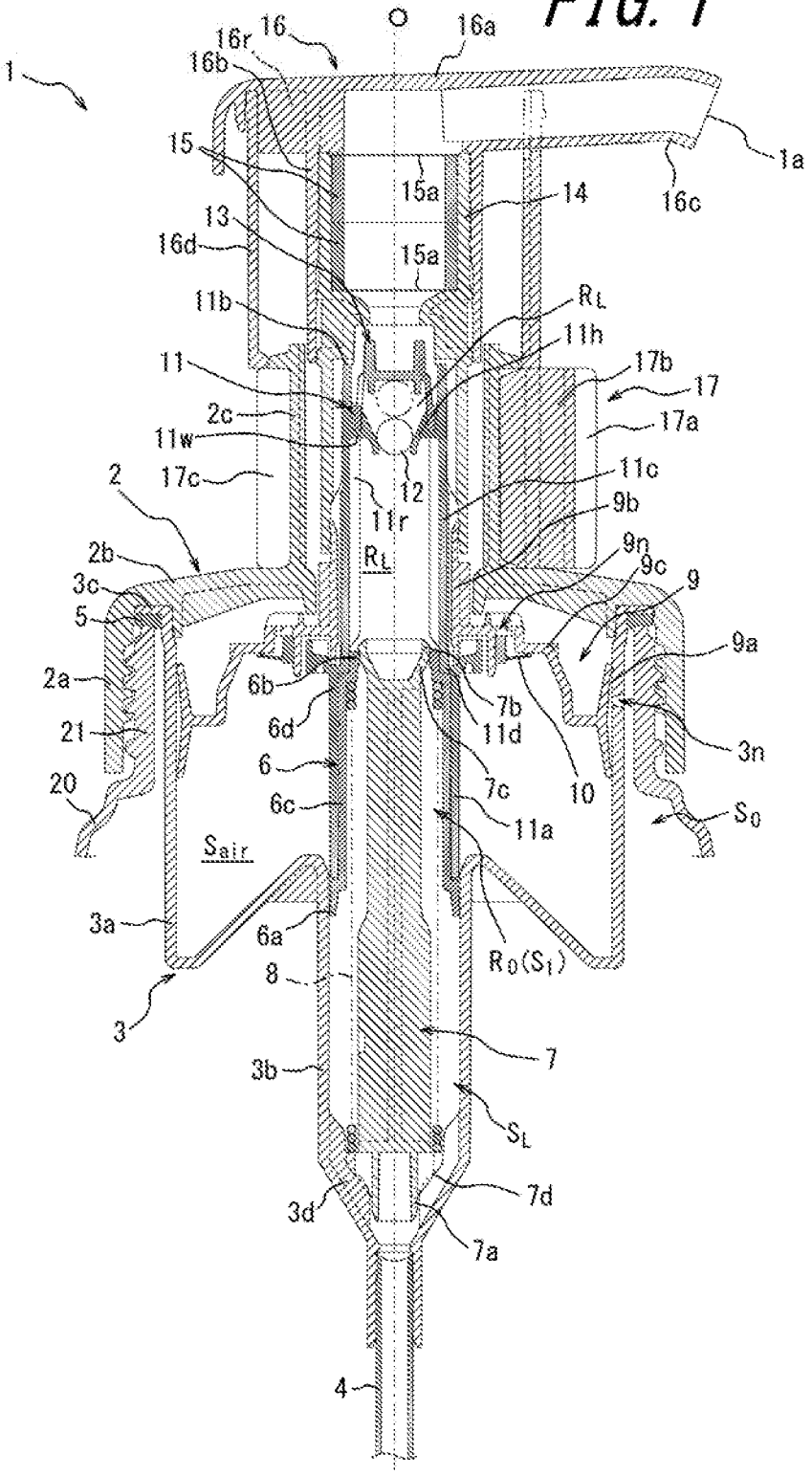
FIG. 1 is a sectional view of a part of a container with a foamer dispenser according to one of embodiments of the present disclosure.

FIGS. 1 to 4 illustrate a container with a foamer dispenser and a part thereof according to the present disclosure. In FIG. 1, reference numeral 20 denotes a synthetic resin container body including a mouth 21. A liquid content medium is filled into an inner space $S_o$ of the container body 20 through the mouth 21. In the present embodiment, the container body 20 is a container having a larger capacity than a capacity of a conventional container.

Reference numeral 1 denotes a foamer dispenser according to one of embodiments of the present disclosure. The foamer dispenser 1 is capable of ejecting a 3 cc of the content medium in the form of foam.

Reference numeral 2 denotes a synthetic resin pump cover. The pump cover 2 includes a fitting portion 2*a* to be fitted to the mouth 21 of the container body 20 and a neck 2*c* connected integrally with the fitting portion 2*a* via a shoulder 2*b*. The neck 2*c* is provided, inside thereof, with a through path. The pump cover 2 may, for example, be provided with a screw portion on an inner circumferential surface of the fitting portion 2*a* as illustrated in the figure and be detachably fitted to the container body 20 by screwing the screw portion to a screw portion provided on an outer circumferential surface of the mouth 21 of the container body 20.

Reference numeral 3 denotes a synthetic resin pump cylinder. The pump cylinder 3 includes a large-diameter portion 3*a* fixed to the pump cover 2 and a small-diameter portion 3*b* having a smaller diameter than the large-diameter portion 3*a*. The small-diameter portion 3*b* is provided in a lower end portion thereof with a suction port, and a tube 4 is connected to the suction port. When the pump cover 2 is fitted to the mouth 21 of the container body 20, the pump cylinder 3 is positioned in the inner space $S_o$ through the mouth 21 of the container body 20 as illustrated in the figure. In the illustrated example, an upper end of the large-diameter portion 3*a* of the pump cylinder 3 is formed as an outward annular flange 3*c*. Between the annular flange 3*c* and an upper end of the mouth 21 of the container body 20, an O-ring 5 is disposed. The O-ring seals between the container body 20 and the pump cylinder 3.

Reference numeral 6 denotes a synthetic resin small-diameter piston. The small-diameter piston 6 is received in the small-diameter portion 3*b* of the pump cylinder 3 and configured to suck and pump the content medium in the container body 20. In the present embodiment, the small-diameter piston 6 includes an annular seal portion 6*a*, which is slidable on an inner circumferential surface of the small-diameter portion 3*b* of the pump cylinder 3, and a tubular portion 6*c*, which extends from the annular seal portion 6*a* toward the large-diameter portion 3*a* of the pump cylinder 3. The tubular portion 6*c* is provided on an inner side thereof with a through path $R_o$ which is open in an upper end portion 6*b* of the small-diameter piston 6. In the present embodiment, the upper end portion 6*b* of the small-diameter piston 6 is connected to the tubular body 6*c* via an annular step 6*d*. Accordingly, a step is also formed in the through path $R_o$ due to the annular step 6*d*, and an inner diameter of an upper end opening formed in the upper end portion 6*b* is smaller than a lower end opening formed on an inner side of the annular seal portion 6*a*.

Reference numeral 7 denotes a synthetic resin plunger. The plunger 7 extends upward inside the pump cylinder 3 from the small-diameter portion 3*b* to the large-diameter portion 3*a* of the pump cylinder 3 and also extends throughout the small-diameter piston 6.

In the present embodiment, a plurality of fins 7*d* is disposed at an interval about an axis O in a lower end portion 7*a* of the plunger 7. Furthermore, a plurality of fins 3*d* is disposed at an interval about the axis O in the small-diameter portion 3*b* of the pump cylinder 3. The plunger 7 is arranged in the small-diameter portion 3*b* of the pump cylinder 3 in a manner such that the fins 7*d* of the plunger 7 are alternated with the fins 3*d* of the pump cylinder 3.

On the other hand, an upper end portion 7*b* of the plunger 7 includes a conical portion 7*c* having a diameter increased upward. The conical portion 7*c* of the plunger 7 is formed larger than the inner diameter of the opening formed in the upper end portion 6*b* of the small-diameter piston 6. As described earlier, the upper end portion 6*b* of the small-diameter piston 6 is reduced in diameter via the annular step 6*d*. The conical portion 7*c* of the plunger 7 may be brought into contact with the upper end portion 6*b* of the small-diameter piston 6 by forcedly extracting the opening formed in the upper end portion 6*b*. That is to say, by the conical portion 7*c* of the plunger 7 contacting the upper end portion 6*b* of the small-diameter piston 6, the upper end opening formed in the upper end portion 6*b* may be sealed in an openable manner. As a result, a pump chamber $S_L$ is formed in the small-diameter portion 3*b* of the pump cylinder 3. The content medium, after pressurized in the small-diameter piston 6, is pumped out from the pump chamber $S_L$ by releasing of the plunger 7.

Reference numeral 8 denotes an elastic member that may be deformed and restored. The elastic member 8 is disposed between the plunger 7 and the small-diameter piston 6 in a compressed state. Accordingly, by pressing the upper end opening of the small-diameter piston 6 against the outer circumferential surface of the conical portion 7*c* of the plunger 7, the elastic member 8 firmly seals the through path $R_o$ of the small-diameter piston 6 in an openable manner. That is to say, the plunger 7 serves, only when the small-diameter piston 6 is pushed down against elastic force of the elastic member 8, as a suction valve (check valve) configured to open the through path $R_o$ of the small-diameter piston 6. In the present embodiment, the elastic member 8 is formed by a metallic or a synthetic resin spring.

Reference numeral 9 denotes a synthetic resin large-diameter piston. The large-diameter piston 9 has a diameter that is larger than the diameter of the small-diameter piston 6. The large-diameter piston 9 is received in the large-diameter portion 3*a* of the pump cylinder 3 and configured to suck and pump ambient air. In the present embodiment, the large-diameter piston 9 includes an annular seal portion 9*a*, which is slidable on an inner circumferential surface of the large-diameter portion 3*a* of the pump cylinder 3, and a tubular portion 9*b*, which extends upward from the annular seal portion 9*a* via an annular wall 9*c*. The tubular portion 9*b* is provided, inside thereof, with a through path.

The annular wall 9*c* of the large-diameter piston 9 is provided with a plurality of ambient air introduction holes 9*n* arranged at an interval about the axis O. The ambient air introduction holes 9*n* allow ambient air, after introduced through an ambient air introduction hole 3*n* formed in the large-diameter portion 3*a* of the pump cylinder 3, to be introduced to an air pump chamber $S_{air}$ formed between the large-diameter piston 9 and the large-diameter portion 3*a* of the pump cylinder 3.

Reference numeral 10 denotes a check valve configured to open and close the ambient air introduction holes 9*n* provided in the large-diameter piston 9. When the large-diameter piston 9 is pushed in and the air pump chamber $S_{air}$ is compressed, the check valve 10 closes the ambient air introduction holes 9*n* of the large-diameter piston 9 to prevent outflow of ambient air, and when the pushing of the large-diameter piston 9 is released and the air pump chamber $S_{air}$ is expanded, the check valve 10 opens the ambient air introduction holes 9*n* of the large-diameter piston 9 by the negative pressure in the air pump chamber $S_{air}$ to allow ambient air to be introduced through the ambient air introduction hole 3*n* of the pump cylinder 3. Examples of the check valve 10 include an elastic valve made of a synthetic resin.

Reference numeral 11 denotes a synthetic resin piston guide. The piston guide 11 is provided inside thereof with a liquid flow path $R_L$ of the content medium pumped from the small-diameter piston 6 and extends throughout the large-diameter piston 9 in a manner such that relative movement is permitted. In the present embodiment, the piston guide 11 includes a fixed tube 11*a*, which is fixed to an outer circumferential surface of the tubular portion 6*c* of the small-diameter piston 6 and a tubular portion 11*c*, which extends upward from the fixed tube 11*a* toward the neck 2*c* of the pump cover 2. In the present embodiment, the tubular portion 11*c* of the piston guide 11 is connected to the fixed tube 11*a* via an annular step 11*d*. The above structure allows positioning of the small-diameter piston 6 by bringing the annular step 6*d* into abutment against the annular step 11*d* of the piston guide 11.

Figure 2:
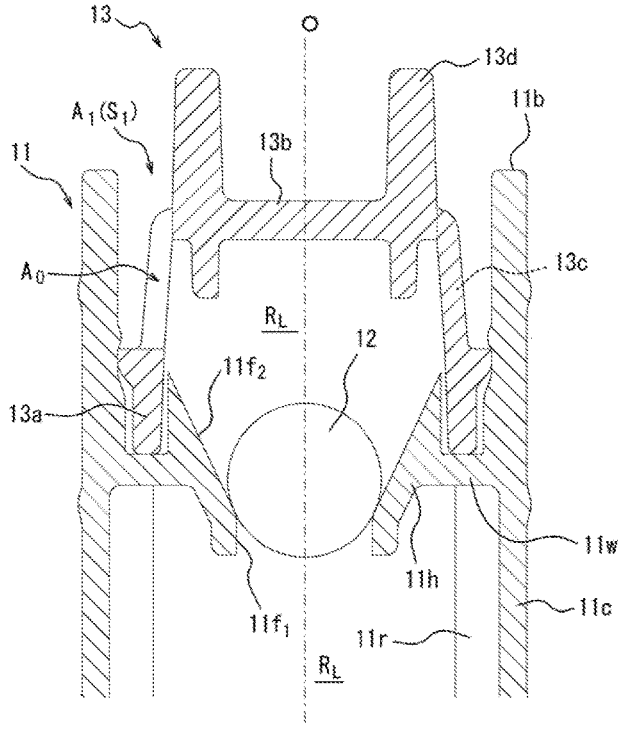
FIG. 2 is an enlarged view of an upper end portion of a piston guide of FIG. 1.

The piston guide 11 is also provided inside thereof with a partition wall 11*w* located below an upper end 11*b* of the piston guide 11. In the partition wall 11*w* of the piston guide, a tubular portion 11*h* is provided. As illustrated in FIG. 2, the through path formed on an inner side of the tubular portion 11*h* is defined by a constant-diameter inner circumferential surface $11f_1$ extending from the lower end with a constant diameter and an increased-diameter inner circumferential surface $11f_2$ connected to the constant-diameter inner circumferential surface $11f_1$ with a diameter increasing toward the upper end.

Furthermore, in the present embodiment, as illustrated in FIG. 2, the tubular portion 11*c* is provided, on an inner circumferential surface thereof, with a plurality of protruding ridges 11*r* extending toward the lower end from the partition wall 11*w*. In the present embodiment, the protruding ridge 11*r* is arranged in 6 locations at an interval about the axis O. However, the protruding ridge 11*r* may be arranged in at least one location.

Reference numeral 12 denotes a metallic or a synthetic resin ball member. The ball member 12 rests on the increased-diameter inner circumferential surface $11f_2$ of the tubular portion 11*h* provided in the piston guide 11 to seal the inner side of the tubular portion 11*h* in an openable manner.

Reference numeral 13 denotes a synthetic resin slip-off preventing member configured to prevent the ball member 12 from slipping out. The slip-off preventing member 13 is fixed to the inner circumferential surface of the piston guide 11 that is located near the upper end 11*b* to form space in which the ball member 12 is received. The slip-off preventing member 13, together with the piston guide 11, forms an opening port $A_1$ on an inner side of the upper end 11*b* of the piston guide 11. The opening port $A_1$ serves to open the liquid flow path $R_L$ provided in the piston guide 11.

In the present embodiment, the slip-off preventing member 13 includes a circumferential wall 13*a*, which is fixed between the inner circumferential surface of the piston guide 11 that is located near the upper end 11*b* and the tubular portion 11*h*, a ceiling wall 13*b* located above the ball member 12, and a plurality of connecting pieces 13*c* connected to the ceiling wall 13*b* and the circumferential wall 13*a*. The connecting pieces 13*c* are arranged at an interval about the axis O, so that a plurality of apertures $A_0$ are formed between adjacent connecting pieces 13*c*. For example, 3 apertures $A_0$ may be formed. In the present embodiment, a tubular portion 13*d* extends upward from and is integrated with an outer edge of the ceiling wall 13*b*. The above structure forms the annular opening port $A_1$ extending around the axis O on the inner side of the upper end 11*b* of the piston guide 11 and between the upper end 11*b* and the tubular 13*d*. That is to say, in the present embodiment, the opening port $A_1$ of the liquid flow path $R_L$ forms an annular flow path area $S_1$ defined by the upper end 11*b* of the piston guide 11 and the tubular portion 13*d* of the slip-off preventing member 13.

In this way, in the liquid flow path $R_L$ provided inside the piston guide 11 in the present embodiment, the annular opening port $A_1$ formed in the upper end 11*b* of the piston guide 11 is opened and closed by the ball member 12. That is to say, the ball member 12 serves as a discharge valve (check valve) that, only when the plunger 7 is released and the content medium is pumped to the liquid flow path $R_L$ of the piston guide 11, opens the annular opening port $A_1$ formed in the upper end 11*b* of the piston guide 11. Especially in the present embodiment, the liquid flow path $R_L$ formed between the plunger 7 and the ball member 12 also serves as an accumulator that pressurizes the content medium, after pumped from the small-diameter piston 6, to a predetermined pressure and pump the pressurized content medium. As shown in Fig. 1, the check valve is located in the liquid flow path $R_L$ on a downstream side of the small-diameter piston.6.

Figure 3:
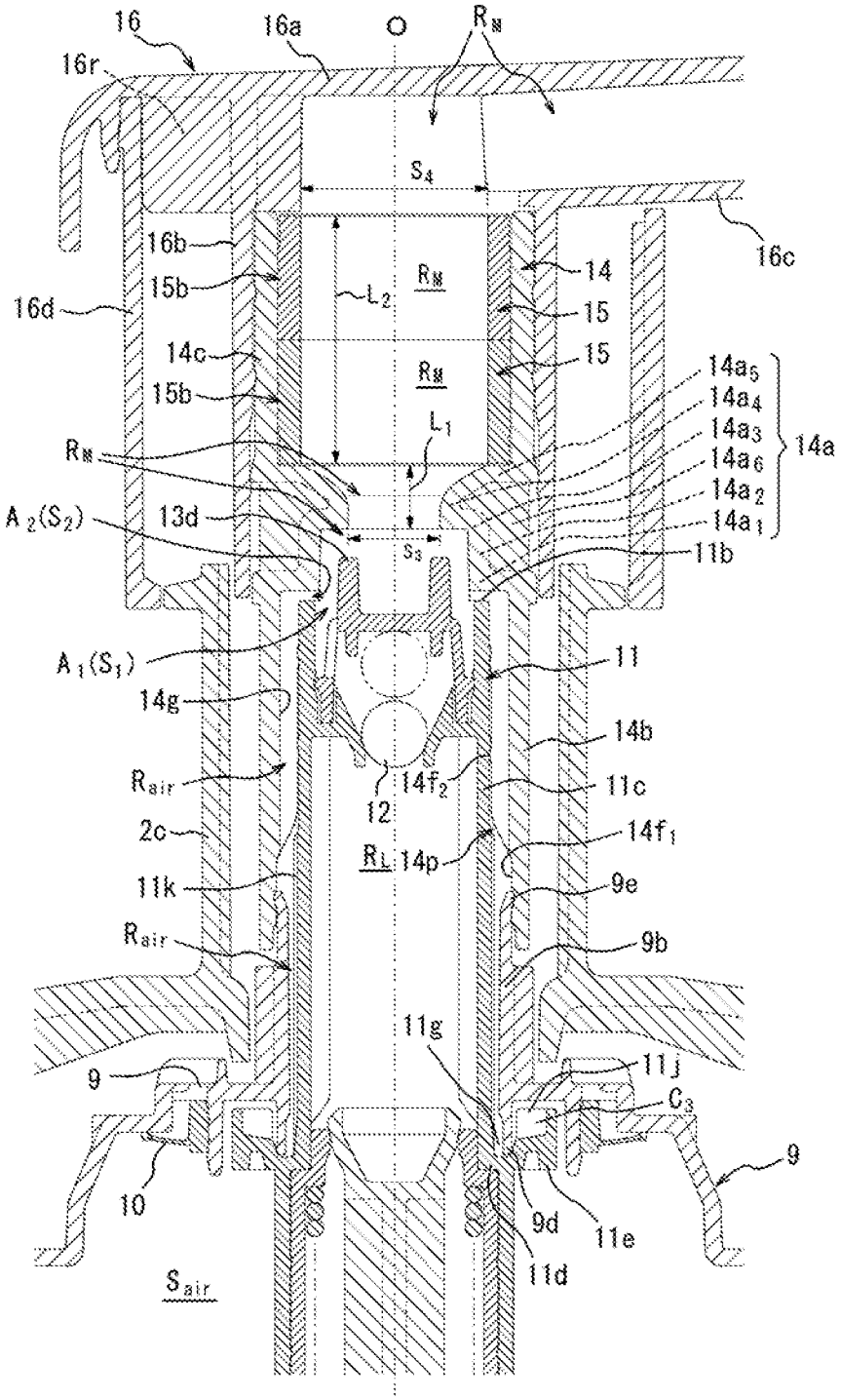
FIG. 3 is an enlarged view of FIG. 1.

As illustrated in FIG. 3, the tubular portion 11*c* of the piston guide 11 extends throughout the inner side of the tubular portion 9*b* of the large-diameter piston 9. Between the tubular portion 11*c* of the piston guide 11 and the tubular portion 9*b* of the large-diameter piston 9, a gap is formed to allow relative movement in the direction of the axis O.

Besides, the tubular portion 11*c* of the piston guide 11 is provided with a plurality of annular protrusions 11*e* extending around the axis O. Each annular protrusion 11*e* is provided, on an upper side thereof, with an annular groove 11*g* extending around the axis O. A lower end portion 9*d* of the tubular portion 9*b* of the large-diameter piston 9 may be brought into contact with the annular groove 11*g*. With the above structure, when the lower end portion 9*d* of the tubular portion 9*b* of the large-diameter piston 9 comes off the annular groove 11*g* of the piston guide 11 and the contact is released, the air pump chamber $S_{air}$, which is formed between the large-diameter piston 9 and the large-diameter portion 3*a* of the pump cylinder 3, is brought into communication with the gap formed between the tubular portion 11*c* of the piston guide 11 and the tubular portion 9*b* of the large-diameter piston 9. That is to say, the tubular portion 9*b* of the large-diameter piston 9 and the annular groove 11*g* of the piston guide 11 serve as an opening/closing valve, and the gap serves as the first ambient air path $R_{air}$ for the ambient air which has been pumped from the large-diameter piston 9.

In the present embodiment, a plurality of protruding ridges 11*k* are provided at an interval about the axis O on an outer circumferential surface of the tubular portion 11*c* of the piston guide 11. In the present embodiment, the protruding ridge 11*k* is arranged in 12 locations at an interval about the axis O. The protruding ridges 11*k* guide ambient air without contacting the tubular portion 9*b* of the large-diameter piston 9. Additionally, the protruding ridge 11*r* may be arranged in at least one location.

In the present embodiment, an annular cutout extending around the axis O is further formed in an upper end of each annular protruding portion 11*e*. In the cut-out, a plurality of guide walls 11*j* are provided at an interval about the axis O, and a plurality of receiving portions $C_3$, configured to prevent inflow of foreign substances, is also provided between adjacent guide walls 11*j*. The guide walls 11*j* are arranged to be aligned with the protruding ridge 11*k*. That is to say, in the present embodiment, the guide wall 11*j* is also arranged in 12 locations at an interval about the axis O. However, the guide wall 11*j* may also be arranged in at least one location.

Figure 4:
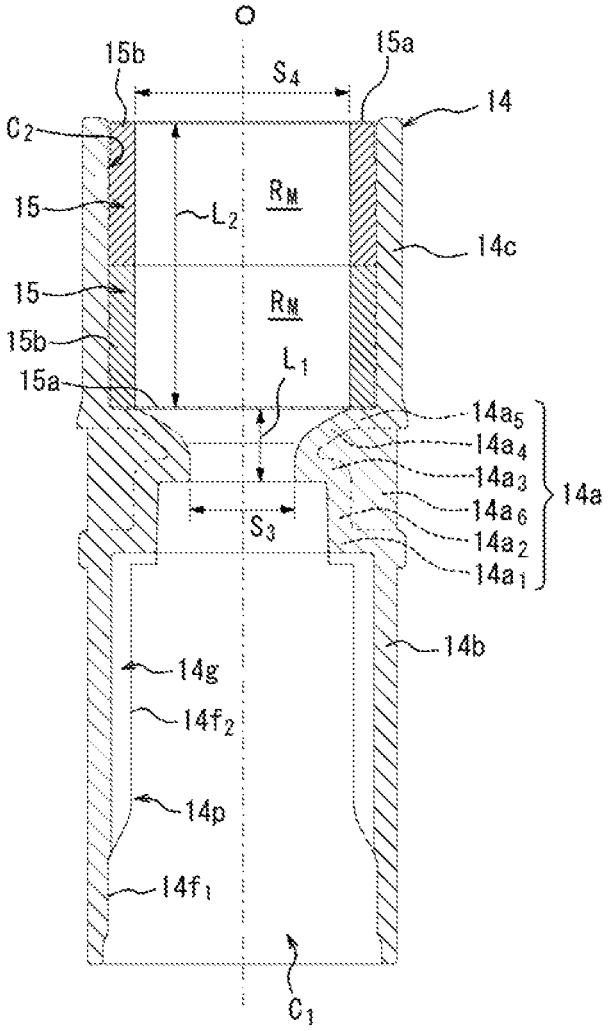
FIG. 4 is a part view of a section of a jet ring in which a mesh ring is mounted.

Reference numeral 14 denotes a synthetic resin jet ring. As illustrated in FIG. 4, the jet ring 14 includes a lower-end side concave portion $C_1$, in which the upper end 11*b* side of the piston guide 11 is received, an upper-end side concave portion $C_2$, in which two mesh rings 15 which are described later are received, and a separation wall 14*a*, which separates the lower-end side concave portion $C_1$ from the upper-end side concave portion $C_2$ and is provided with a through path. In the present embodiment, the separation wall 14*a* is formed as a circumferential wall that connects a lower-end side circumferential wall 14*b*, which surrounds the upper end 11*b* side of the piston guide 11, and an upper-end side circumferential wall 14*c*, which surrounds the two mesh rings 15.

In more detail, the separation wall 14*a* is formed by the first reduced circumferential wall portion 14$a_1$, which is connected to the lower-end side circumferential wall 14*b* and has an inner diameter smaller than the smaller inner diameter of the lower-end side circumferential wall 14*b*, a same-diameter circumferential wall portion 14$a_2$, which has the same inner diameter as the first reduced circumferential wall portion 14$a_1$, the second reduced circumferential wall portion 14$a_3$, which has an inner diameter smaller than that of the same-diameter circumferential wall portion 14$a_2$, a large-diameter circumferential wall portion 14$a_4$, which has a diameter increased from the second reduced circumferential wall portion 14$a_3$ to the upper end, and the third reduced circumferential wall portion 14$a_5$, which, together with the large-diameter circumferential wall portion 14$a_4$, is connected to the upper-end side circumferential wall 14*c* and which has an inner diameter smaller than that of the upper-end side circumferential wall 14*c*.

Especially in the present embodiment, a plurality of reinforcing plates 14$a_6$ is provided at an interval about the axis O between the first reduced circumferential wall portion 14$a_1$ and the third reduced circumferential wall portion 14$a_5$. The reinforcing plate 14$a_6$ may be arranged in 4 locations at an equal interval about the axis O. The result is that the separation wall 14*a* is formed as a waist, and the amount of resin used in the jet ring 14 is reduced. Moreover, the mesh ring 15 may be enlarged, and the amount of foam to be dispensed is increased. However, reinforcing plate 14$a_6$ may be arranged in at least one location.

Furthermore, an annular bulging portion 14*p* extending around the axis O is provided on an inner circumferential surface 14$f_1$ of the lower-end side circumferential wall 14*b* of the jet ring 14. The bulging portion 14*p* forms, on an inner side of the lower-end side circumferential wall 14*b*, an inner circumferential surface 14$f_2$ having an inner diameter smaller than that of the inner circumferential surface 14$f_1$. In the present embodiment, the inner diameter of the bulging portion 14*p* is defined as the smallest inner diameter of the lower-end side circumferential wall 14*b*. Besides, in the lower-end side concave portion $C_1$ of the jet ring 14, a plurality of L-shaped grooves 14*g* is formed to extend from the bulging portion 14*p* to the first reduced circumferential wall portion 14$a_1$ of the separation wall 14*a*. In the present embodiment, the L-shaped groove 14*g* is arranged in 12 locations at an interval about the axis O. However, the L-shaped groove 14*g* may be arranged in at least one location.

Reference numeral 15 denotes the mesh ring that is received in the upper-end side concave portion $C_2$ of the jet ring 14. The mesh ring 15 includes a mesh filter 15*a*. The mesh filter 15*a* is a member formed with fine apertures through which the content medium may pass and is, for example, a resin net. The mesh filter 15*a* is fixed to an end of a synthetic resin ring member 15*b*. The ring member 15*b*, together with the mesh filter 15*a*, is fitted and held inside the upper-end side concave portion $C_2$ of the jet ring 14.

As illustrated in FIG. 3, the jet ring 14 receives the upper end 11*b* side of the piston guide 11, with the upper end 11*b* of the piston guide 11 abutting against the first reduced circumferential wall portion 14*a*$_1$ and with the outer circumferential surface of the tubular portion 11*c* of the piston guide 11 fitted to an inner circumferential surface $f_2$ of the bulging portion 14*p* provided in the lower-end side circumferential wall 14*b*. This allows the opening port $A_1$ of the piston guide 11 to communicate with the upper-end side concave portion $C_2$ of the jet ring 14 through the through path provided in the separation wall 14*a* of the jet ring 14.

Furthermore, since in the present embodiment the L-shaped grooves 14*g* are formed to extend from the bulging portion 14*p* of the jet ring 14 to the first reduced circumferential wall portion 14*a*$_1$ of the separation wall 14*a*, the second ambient air flow paths $R_{air}$ are formed between the piston guide 11 and the jet ring 14. The second ambient air flow paths $R_{air}$ allow the ambient air that has been pumped from the large-diameter piston 9 to communicate with the through path provided in the separation wall 14*a* of the jet ring 14. In the present embodiment, 12 second ambient air flow paths $R_{air}$, defined by the L-shaped grooves 14*g* of the jet ring 14 and the piston guide 11, are formed. That is to say, in the present embodiment, an opening port $A_2$ of the second ambient air flow paths $R_{air}$ has a flow path area $S_2$ defined by the L-shaped grooves 14*g* formed in the first reduced circumferential wall portion 14*a*$_1$ of the separation wall 14*a* of the jet ring 14 and the upper end 11*b* of the piston guide 11. Additionally, the second ambient air flow path $R_{air}$ may be arranged in at least one location.

In the present embodiment, the inner circumferential surface 14*f*$_1$ of the lower-end side circumferential wall 14*b* of the jet ring 14 is sealed and slidably held by an upper end portion 9*e* of the tubular portion 9*b* of the large-diameter piston 9. This allows the second ambient air flow paths $R_{air}$ to communicate with the first ambient air flow paths $R_{air}$ in an air-tight manner.

The through path provided in the separation wall 14*a* forms the first mixture flow path $R_M$ for a mixture of the content medium pumped from the opening port $A_1$ of the liquid flow path $R_L$ and the ambient air pumped from the opening port $A_2$ of the second ambient air flow paths $R_{air}$. In the present embodiment, in a portion of the first mixture flow path $R_M$ that is located on the inner side of the of the same-diameter circumferential wall 14*a*$_2$ of the jet ring 14, the tubular portion 13*d* of the slip-off preventing member 13 may be received. This enlarged path, in which the tubular portion 13*d* of the slip-off preventing member 13 is received, extends from the smallest inner diameter path formed on the inner side of the second reduced circumferential wall portion 14*a*$_3$ to the large-diameter circumferential wall portion 14*a*$_4$ and to the curved path formed on the inner side of the third reduced circumferential wall portion 14*a*$_5$ and then, communicates with the second mixture flow path $R_M$ formed on the inner side of the ring member 15*b* of the mesh ring 15.

Next, reference numeral 16 in FIG. 3 denotes a synthetic resin head. By a user pushing and releasing the head 16 repeatedly, the head 16 causes pumping movement of the small-diameter piston 6 and the large-diameter piston 9 and ejects the mixture of the content medium and ambient air. In the present embodiment, the head 16 includes a ceiling wall 16*a*, on which the user performs a pushing operation, and a fixing tube 16*b* suspended from the ceiling wall 16*a*. Inside the fixing tube 16*b*, the upper-end side circumferential wall 14*c* of the jet ring 14 is fitted and held. The head 16 further includes a nozzle 16*c* communicating with the inside of the fixing tube 16*b*. As illustrated in FIG. 1, the nozzle 16*c* is provided in a front end thereof with an ejection orifice 1*a* from which the content medium, after passing through the mesh rings 15, is ejected in the form of foam.

Furthermore, the ceiling wall 16*a* of the head 16 is provided in a lower end thereof with a plurality of fixing ribs 16*r* extending radially around the fixing tube 16*b*. In the lower end of the ceiling wall 16*a* of the head 16, an outer tube 16*d* as a separate member is also disposed. In the present embodiment, the outer tube 16*d* may receive the fixing ribs 16*r* on the inner side of the outer tube 16*d* and may be fixed by the fixing ribs 16*r*.

In FIG. 1, reference numeral 17 denotes a stopper configured to prevent the head 16 form pushed down. The stopper 17 is an existing stopper that is arranged detachably between the shoulder 2*c* of the pump cover 2 and the outer tube 16*d* of the head 16. That is to say, the stopper 17 includes two curved arms 17*c* extending, in a C-shape in the cross section, from a base 17*b* having a grip 17*a*, thereby detachably fitted to the neck 2*c* of the pump cover 2. Thus, the stopper 17 contacts the upper end of the shoulder 2*c* and the lower end of the outer tube 16*d* and prevents the head 16 from pushed down.

The large container with a foamer dispenser according to the present disclosure allows a large volume of content medium, after pumped from the container body 20, to pass through the mesh filters 15*a* and ejects the content medium in the form of foam by repeated pushing and releasing of the head 16.

In the present embodiment, as illustrated in FIG. 3, a connecting flow path area $S_1$ between the liquid flow path $R_L$ and the mixture flow path $R_M$ and a connecting flow path area $S_2$ between the ambient air flow path $R_{air}$ and the mixture flow path $R_M$ are defined, and the connecting flow path area $S_1$ for the liquid and the connecting flow path area $S_2$ for ambient air satisfy the following condition.

$$2.8 \leq S_1/S_2 \leq 3.8$$

$$(2.8:1 \leq S_1:S_2 \leq 3.8:1) \quad (1)$$

More preferably, the connecting flow path area $S_1$ for the liquid and the connecting flow path area $S_2$ for ambient air are set to satisfy the following condition.

$$S_1/S_2 = 3.8$$

$$(S_1:S_2 = 3.8:1) \quad (2)$$

Furthermore, in the present embodiment, in a through path formed inside the jet ring 14, the same-diameter circumferential wall portion 14*a*$_2$ has the smallest inner diameter. That is to say, the smallest flow path area $S_3$ of the mixture flow path $R_M$ is located on an immediately upstream side of one of the mesh filters 15*a*. In this case, the smallest flow path area $S_3$ of the mixture flow path $R_M$ and a flow path area $S_4$ of the mesh filter 15*a* are preferably set to satisfy the following condition.

$$4 \leq S_4/S_3 \leq 10.3$$

$$(1:4 \leq S_3:S_4 \leq 1:10.3) \quad (3)$$

Preferably, the smallest flow path area $S_3$ of the mixture flow path $R_M$ and the flow path area $S_4$ of the mesh filter 15*a* are set to satisfy the following condition.

$$S_4/S_3 \leq 10.1$$

$$(1:4 S_3:S_4 1:10.1) \quad (4)$$

More preferably, the smallest flow path area $S_3$ of the mixture flow path $R_M$ and the flow path area $S_4$ of the mesh filter 15*a* are set to satisfy the following condition.

$$4 \leq S_4/S_3 \leq 6.2$$

$$(1:4 \leq S_3:S_4 \leq 1:6.2) \quad (5)$$

Even more preferably, the smallest flow path area $S_3$ of the mixture flow path $R_M$ and the flow path area $S_4$ of the mesh filter 15*a* are set to satisfy the following condition.

$$S_4/S_3=4$$

$$(S_3:S_4=1:4) \quad (6)$$

Moreover, in the present embodiment, the mesh filter 15*a* is arranged in two locations in the mixture flow path $R_M$. In this case, an interval $L_1$ between the smallest flow path area $S_3$ of the mixture flow path $R_M$ and the flow path area $S_4$ of the mesh filter 15*a* and an interval $L_2$ between the mesh filters 15*a* are preferably set to satisfy the following condition.

$$L_2/L_1=3.9$$

$$(L_1:L_2=1:3.9) \quad (7)$$

Moreover, the foamer dispenser of the present embodiment includes the piston guide 11, inside of which the liquid flow path $R_L$ of the content medium pumped from the small-diameter piston 6 is formed, and which extends throughout the large-diameter piston 9 in a manner such that relative movement is permitted, and the jet ring 14, which includes the lower-end side concave portion $C_1$ in which the upper end 11*b* side of the piston guide 11 is received, the upper-end side concave portion $C_2$ in which the mesh filters 15*a* are received, and the through path provided in the separation wall 14*a* separating the lower-end side concave portion $C_1$ from the upper-end side concave portion $C_2$.

Furthermore, the annular bulging portion 14*p* is provided on the inner circumferential surface of the lower-end side concave portion $C_1$ of the jet ring 14, the upper end 11*b* of the piston guide 11 is abutted against the separation wall 14*a* of the jet ring 14, the piston guide 11 is fitted to the inner side of the bulging portion 14*p*, and the inner diameter surface of the lower-end side concave portion $C_1$ of the jet ring 14 is sealed slidably by the large-diameter piston 9.

Moreover, the plurality of L-shaped grooves 14*g* is formed to extend from the bulging portion 14*p* to the separation wall 14*a* of the jet ring 14 to form the plurality of ambient air flow paths $R_{air}$ between the piston guide 11 and the jet ring 14. The ambient air flow paths $R_{air}$ allow the ambient air that has been pumped from the large-diameter piston 9 to communicate with the lower-end side concave portion $C_1$ of the jet ring 14. The ambient air flow paths $R_{air}$, together with the liquid flow path $R_L$ of the piston guide 11, are connected to the through path of the separation wall 14*a*.

Moreover, the upper end 11*b* side of the jet ring 14 is connected to the head 16.

Using an assembly of the piston guide 11 and the jet ring 14 according to the present embodiment facilitates settings of the connecting flow path area $S_1$ for the liquid and the connecting flow path area $S_2$ for ambient air. For example, as illustrated in FIG. 2, the connecting flow path area $S_1$ for the liquid is defined between the upper end 11*b* of the piston guide 11 and the tubular portion 13*d* of the slip-off preventing member 13. Accordingly, the connecting flow path area $S_1$ for the liquid may be suitably changed simply by changing an inner diameter of the upper end 11*b* of the piston guide 11 and an outer diameter of (the tubular portion 13*d* of) the slip-off preventing member 13. Moreover, the connecting flow path area $S_2$ for ambient air is defined by the L-shaped grooves 14*g* of the jet ring 14 illustrated in FIG. 4, and accordingly, the connecting flow path area $S_2$ may be suitably changed simply by changing the width and depth of the L-shaped grooves 14*g*.

Next, another embodiment of the present disclosure is described. This other embodiment is also directed to the foamer dispenser with the structure illustrated in FIGS. 1 to 4 in which the same-diameter circumferential wall portion 14*a*$_2$ has the smallest inner diameter in the through path formed inside the jet ring 14. That is to say, the smallest flow path area $S_3$ of the mixture flow path $R_M$ is located on an immediately upstream side of one of the mesh filters 15*a*. The smallest flow path area $S_3$ of the mixture flow path $R_M$ and a flow path area $S_4$ of the mesh filter 15*a* are preferably set to satisfy the aforementioned condition (3). Thus, in the foamer dispenser with the structure illustrated in FIGS. 1 to 4 according to the other embodiment of the present disclosure, the smallest flow path area $S_3$ of the mixture flow path $R_M$ is located on an immediately upstream side of one of the mesh filters 15*a*, and the smallest flow path area $S_3$ and the flow path area $S_4$ of the mesh filter 15*a* are preferably set to satisfy the same condition as the condition (3).

In this other embodiment also, in addition to the condition (3), the aforementioned conditions (4) to (7) are preferably satisfied. Furthermore, in addition to the condition (3), the aforementioned conditions (1) and (2) may also be satisfied.

The following describes test results of Examples using a foamer dispenser with the structure illustrated in FIGS. 1 to 4 and Comparative Examples. The tests were conducted by using a body soap (skin cleanser) with ingredients of Table 1 shown below as the content medium of Examples and Comparative Examples.

TABLE 1

| Ingredients | Mass % |
|---|---|
| Sodium laurylaminopropionate | 3 |
| Lauramidopropyl betaine | 20 |
| Sodium N-cocoyl methyl taurate | 2 |
| Polyoxyethylene (2) disodium alkyl (12-14) sulfosuccinate | 10 |
| Sorbitol | 3 |
| Glycerin | 3 |
| Proplylene glycol | 20 |
| Sodium benzoate | 0.9 |
| Citrate | 0.7 |
| Honey | 0.1 |
| Sodium DL-pyrrolidone carboxylate solution | 0.1 |
| Dye | 0.01 |
| Purified water | Reminder |

Example 1

$$S_1/S_{2(all)}=3.8$$

$$(S_1:S_{2(all)}=3.8:1)$$

Connecting flow path area $S_1$ for the liquid=27.3 $mm^2$

Connecting flow path area $S_2$ for ambient air=7.2 $mm^2$

Note that the connecting flow path area $S_2$ herein refers to a total sum area $S_2$ of 12 connecting flow paths for ambient air.

Example 2

$S_1/S_{2(all)}=2.8$ $(S_1:S_{2(all)}=2.8:1)$

Connecting flow path area $S_1$ for the liquid=20.16 $mm^2$
Connecting flow path area $S_2$ for ambient air=7.2 $mm^2$
Note that the connecting flow path area $S_2$ herein refers to a total sum area $S_2$ of 12 connecting flow paths for ambient air.

Example 3

$S_4/S_3=4$ $(S_3:S_4=1:4)$

Smallest flow path area $S_3$ of mixture flow path $R_M$=24.63 $mm^2$
Flow path area $S_4$ of mesh filter=98.52 $mm^2$ Example 4

$S_4/S_3=4.2$ $(S_3:S_4=1:4.2)$

Smallest flow path area $S_3$ of mixture flow path $R_M$=23.76 $mm^2$
Flow path area $S_4$ of mesh filter=98.52 $mm^2$ Example 5

$S_4/S_3=6.2$ $(S_3:S_4=1:6.2)$

Smallest flow path area $S_3$ of mixture flow path $R_M$=15.89 $mm^2$
Flow path area $S_4$ of mesh filter=98.52 $mm^2$ Example 6

$S_4/S_3=10$ $(S_3:S_4=1:10)$

Smallest flow path area $S_3$ of mixture flow path $R_M$=9.85 $mm^2$
Flow path area $S_4$ of mesh filter=98.52 $mm^2$ Example 7

$S_4/S_3=10.3$ $(S_3:S_4=1:10.3)$

Smallest flow path area $S_3$ of mixture flow path $R_M$=9.57 $mm^2$
Flow path area $S_4$ of mesh filter=98.52 $mm^2$ In the following, test results of the aforementioned Examples 1 to 7 according to the present disclosure are shown in Table 2. In Table 2, "good" indicates that the foam quality is good, and "excellent" indicates that the foam quality is better than good.

TABLE 2

| | Foam quality |
|---|---|
| Example 1 | Excellent |
| Example 2 | Good |
| Example 3 | Excellent |
| Example 4 | Good |
| Example 5 | Good |
| Example 6 | Good |
| Example 7 | Good |

It can be clearly seen from Examples 1 and 2 in Table 2 shown above that the foam quality of the ejected foam may be improved by setting the connecting flow path area $S_1$ for the liquid and the connecting flow path area $S_2$ for ambient air to satisfy the aforementioned condition (1). Especially, as can be clearly seen from Example 1, the foam quality is better when the aforementioned condition (2) is satisfied.

It can also be clearly seen from Examples 3 to 7 in Table 2 shown above that the foam quality of the ejected foam may be improved by setting the smallest flow path area $S_3$ of the mixture flow path $R_M$ and the flow path area $S_4$ of the mesh filter to satisfy the aforementioned conditions (3) to (6). Especially, as can be clearly seen from Example 3, the foam quality is better when the condition (6) is satisfied. In cases of Examples 3 to 7, in which the smallest flow path area $S_3$ of the mixture flow path $R_M$ and the flow path area $S_4$ of the mesh filter are set to satisfy the conditions (3) to (6), even when a large volume is ejected from the head, the head may be pushed down with feeling of lightness, as opposed to heaviness.

In cases in which Example 1 and Example 3 were combined, the foam quality was also better.

Figure 5A:
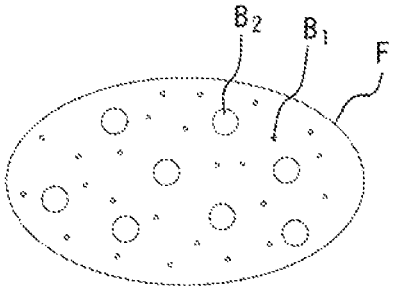
FIG. 5A schematically illustrates the foam quality obtained when a content medium in a container body is ejected by using a conventional foamer dispenser, and FIG. 5B schematically illustrates the foam quality obtained when a content medium in a container body is ejected by using the foamer dispenser of FIG. 1.
Figure 5B:
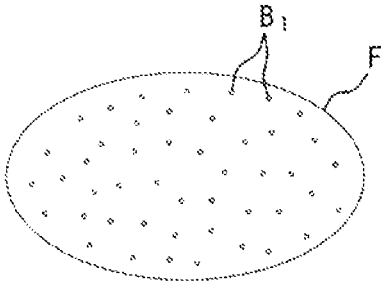

Furthermore, regarding Examples 1 to 7, when the interval $L_1$ between the smallest flow path area $S_3$ and the flow path area $S_4$ of the mesh filter was set to be 3.8 mm and when the interval $L_2$ between the mesh filters was set to be 15 mm and when the dimension settings of $L_1:L_2=1:3.9$ were combined with Example 1 or Example 3, the foam quality was even more than better. Moreover, when the above dimension settings were combined with Example 1 and Example 3, the foam quality was best. The foam quality obtained in this case is schematically illustrated in FIG. 5B. As illustrated in FIG. 5B, according to the present disclosure, the small air bubbles $B_1$ are evenly dispersed in the single piece of foam F compared with conventional example illustrated in FIG. 5A.

Additionally, although Examples use the jet ring of a type that may form the liquid flow path $R_L$ and the air flow path $R_{air}$ at the time of assembly, the present disclosure may also be adopted in a foamer dispenser using the jet ring of a conventional type that may form only the liquid flow path $R_L$.

INDUSTRIAL APPLICABILITY

The present disclosure is applicable to a foamer dispenser that mixes a liquid content medium and ambient air and ejects the mixture in the form of foam and to a container with the foamer dispenser. The content medium may be anything, such as a face cleanser and a hair liquid, that may be mixed with ambient air and ejected in the form of foam.

REFERENCE SIGNS LIST

1 Foamer Dispenser
2 pump cover

3 pump cylinder
3*a* large-diameter portion
3*b* small-diameter portion
6 small-diameter piston
8 elastic member
9 large-diameter piston
11 piston guide
12 ball member
13 slip-off preventing member
13*d* tubular portion
14 jet ring
14*a* separation wall
14$a_1$ first reduced circumferential wall portion
14$a_2$ same-diameter circumferential wall portion
14$a_3$ second reduced circumferential wall portion
14$a_4$ large-diameter circumferential wall portion
14$a_5$ third reduced circumferential wall portion
14$a_6$ reinforcing plate
14*g* L-shaped groove
15 mesh ring
15*a* mesh filter
20 container body
21 mouth
$A_1$ opening port of liquid flow path
$A_2$ opening port of ambient air flow path
$C_1$ lower-end side concave portion of jet ring
$C_2$ upper-end side concave portion of jet ring
$R_L$ liquid flow path
$R_{air}$ ambient air flow path
$R_M$ mixture flow channel
$S_1$ connecting flow path area between liquid flow path and mixture flow path
$S_2$ connecting flow path area between ambient air flow path and mixture flow path
$S_3$ smallest flow path area of mixture flow path
$S_4$ flow path area of mesh filter

The invention claimed is:

1. A foamer dispenser, comprising:

a pump cover that is fitted to a container body; a pump cylinder that includes a large-diameter portion fixed to the pump cover and a small-diameter portion; a small-diameter piston that is received in the small-diameter portion of the pump cylinder and that is configured to suck and pump a liquid in the container body; a large-diameter piston that is received in the large-diameter portion of the pump cylinder and that is configured to suck and pump ambient air; a head that causes pumping movement of the small-diameter piston and the large-diameter piston and that ejects a mixture of the liquid and the ambient air by a user pushing and releasing the head repeatedly; a liquid flow path of the liquid pumped from the small-diameter piston; an ambient air flow path of the ambient air pumped from the large-diameter piston; a mixture flow path of the mixture of the liquid pumped from the liquid flow path and the ambient air pumped from the ambient air flow path; a check valve that is located in the liquid flow path on a downstream side of the small-diameter piston; and a mesh filter that is disposed in the mixture flow path to allow the mixture to pass, wherein a connecting flow path area $S_1$ between the liquid flow path and the mixture flow path and a connecting flow path area $S_2$ between the ambient air flow path and the mixture flow path have the following constant relationship:

$$2.8 \leq S_1/S_2 \leq 3.8, \text{ and}$$

the connecting flow path area between the liquid flow path and the mixture flow path is downstream of the check valve.

2. The foamer dispenser of claim 1, wherein the connecting flow path area $S_1$ and the connecting flow path area $S_2$ have the following relation:

$$S_1/S_2=3.8.$$

3. The foamer dispenser of claim 1, wherein a smallest flow path area $S_3$ of the mixture flow path is located on an immediately upstream side of the mesh filter, and the smallest flow path area $S_3$ and a flow path area $S_4$ of the mesh filter have the following relation:

$$4S_4/S_3 \leq 10.3.$$

4. The foamer dispenser of claim 3, wherein the smallest flow path area $S_3$ and the flow path area $S_4$ of the mesh filter have the following relation:

$$4S_4/S_3 \leq 10.1.$$

5. The foamer dispenser of claim 4, wherein the smallest flow path area $S_3$ and the flow path area $S_4$ of the mesh filter have the following relation:

$$4S_4/S_3 \leq 6.2.$$

6. The foamer dispenser of claim 5, wherein the smallest flow path area $S_3$ and the flow path area $S_4$ of the mesh filter have the following relation:

$$S_4/S_3=4.$$

7. The foamer dispenser of claim 3, wherein the mesh filter is arranged in 2 locations in the mixture flow path, and an interval $L_1$ between the smallest flow path area $S_3$ and the flow path area $S_4$ of the mesh filter and an interval $L_2$ between the mesh filters have the following relation:

$$L_2/L_1=3.9.$$

8. The foamer dispenser of claim 1, further comprising:

a piston guide, inside of which the liquid flow path of the liquid pumped from the small-diameter piston is formed, and which extends throughout the large-diameter piston in a manner such that relative movement is permitted; and a jet ring, which includes a lower-end side portion in which an upper end side of the piston guide is received, an upper-end side portion in which the mesh filter is received, and a through path provided in a separation wall separating the lower-end side portion from the upper-end side portion, wherein the upper end side of the jet ring is connected to the head.

9. A container, comprising:

the foamer dispenser of claim 1, and the container body to which the foamer dispenser is fitted.

10. The foamer dispenser of claim 1, wherein a slip-off preventing member that restricts movement of a valving element of the check valve provides an opening configured to communicate the liquid flow path and the mixture flow path with each other.

* * * * *